United States Patent [19]

Bratkowski et al.

[11] Patent Number: 4,680,562

[45] Date of Patent: Jul. 14, 1987

[54] INTEGRAL CIRCUIT INTERRUPTER WITH SEPARABLE MODULES

[75] Inventors: Walter V. Bratkowski, McKeesport; John A. Wafer, Beaver, both of Pa.

[73] Assignee: Westinghouse Electric Corp., Pittsburgh, Pa.

[21] Appl. No.: 759,719

[22] Filed: Jul. 29, 1985

[51] Int. Cl.[4] ..... H01H 77/06

[52] U.S. Cl. ..... 335/16; 335/195

[58] Field of Search ..... 335/14, 16, 195, 6, 335/18; 361/115

[56] References Cited

U.S. PATENT DOCUMENTS

| | | | |
|---|---|---|---|
| 3,638,157 | 1/1972 | Kruzic | 337/6 |
| 4,025,883 | 5/1977 | Slade et al. | 335/16 |
| 4,042,895 | 8/1977 | Wafer et al. | 335/16 |
| 4,064,469 | 12/1977 | Gryctko | 335/6 |
| 4,077,026 | 2/1978 | Slade et al. | 335/195 |
| 4,220,934 | 9/1980 | Wafer et al. | 335/16 |
| 4,639,700 | 1/1987 | Shestak et al. | 335/6 |

FOREIGN PATENT DOCUMENTS

| | | | |
|---|---|---|---|
| 1185703 | 1/1965 | Fed. Rep. of Germany | 335/195 |
| 1788148 | 5/1973 | Fed. Rep. of Germany | 335/195 |
| 1692 | 1/1970 | Japan | 335/16 |
| 112822 | 5/1966 | Netherlands | 335/195 |

*Primary Examiner*—Charles Frankfort
*Assistant Examiner*—W. Morris Worth
*Attorney, Agent, or Firm*—L. P. Johns

[57] ABSTRACT

An integral circuit interrupter characterized by an assemblage of interconnected electrical units including a circuit breaker, a thermal-magnetic overcurrent detector, an electromagnetic actuator, and a modular sensor; the circuit breaker comprising first and second separable contacts and a releasable lever for releasing the first contact to an open position when the detector trips the lever in response to a first predetermined current condition; the electromagnetic actuator for moving the second contact to an open position; the modular sensor for monitoring current flow and for actuating only the electromagnetic actuator in response to a second predetermined current condition; and the electromagnetic actuator being operable from a remotely controlled source.

5 Claims, 10 Drawing Figures

INTEGRAL CIRCUIT INTERRUPTER WITH SEPARABLE MODULES

CROSS REFERENCE TO RELATED APPLICATIONS

This application is related to opening applications, Ser. No. 670,792, filed Nov. 13, 1984, entitled Magnetically Operated Circuit Breaker, the invention of T. J. Heyne and N. A. Tomasic; and Ser. No. 759,718, filed July 29, 1985, entitled Circuit Breaker with Removable Modular Components, the invention of J. A. Wafer and K. A. Grunert, both assigned to the assignee of this application.

BACKGROUND OF THIS INVENTION

1. Field of the Invention

This invention relates to circuit breakers and, more particularly, to an integral motor controller including separable modules of an electromagnet, circuit breaker, and motor overload relay.

2. Description of the Prior Art

In the past, motor starters and protective devices were usually mounted in separate enclosures. Though the discrete component system used in motor starters and motor control centers have functioned well, it has several disadvantages such as size, cost, and complexity.

Associated with the foregoing is a need for an integral motor controller having a modular construction providing the functions of discrete components of circuit breakers, fuses, contactors, and overload relays (when required). Such a combination is conductive to motor control, automated electrical distribution systems, and energy management.

SUMMARY OF THE INVENTION

The circuit breaker of this invention comprises an electrically insulating housing; a circuit breaker structure within the housing and including first and second separable contacts operable between open and closed positions; the structure also including a releasable lever movable when released to a trip position to effect automatic movement of the first contact from the second contact; the first contact being coupled to the releasable lever; the second contact being movable between open and closed positions of the first contact when the first contact is in the untripped position of the releasable lever; electromagnetic means for moving the second contact between open and closed positions of the first contact; modular sensor means for monitoring current flow and for automatically actuating the electromagnetic means in response to a predetermined current condition; and thermal-magnetic or equivalent detector means for monitoring overcurrent conditions other than the predetermined current conditions and for tripping the releasable lever.

The circuit breaker of this invention includes advantages of the modular concept for removably and replaceably disassembling separate components of circuit breakers, current limiting fuses, contactors, and overload relays having specific ratings or a particular requirement, in which components are easily replaceable in the event of failure. The benefits of such a structure include the substitution of only the failed components instead of an entire unit. Moreover, there is the flexibility on control by plugging in (or adding) additional control components where required.

DESCRIPTION OF THE PREFERRED EMBODIMENTS

Figure 1:
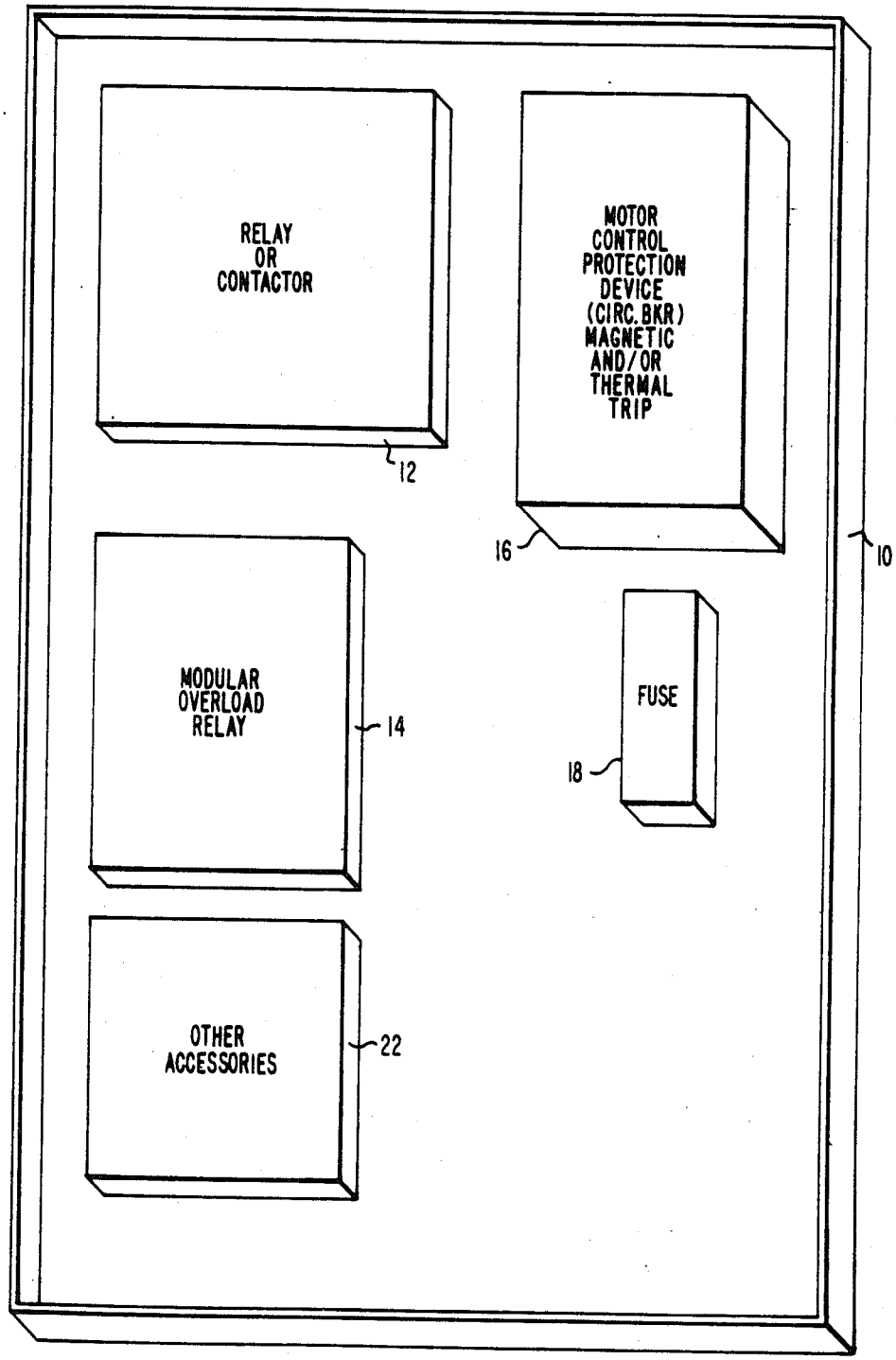
FIG. 1 PRIOR ART
FIG. 1 is a schematic view showing prior art assembly of the several parts contained within a conventional metal box mounted on a panel or wall.

Heretofore combination starters and protective devices have usually been mounted in the same enclosure. Separate circuit breakers, fuses, contactors, and overload relays have been used in the combination controller units. In FIG. 1 a prior art combination of starters and protective devices for preventing downstream damage to electrical equipment included a panel metal enclosure 10 for containing required electrical devices, such as a relay or contactor 12, an overload relay 14, a motor control protective device such as a circuit breaker 16, a fuse 18, and other related accessories 22. The several devices 12 to 22 were disposed in spaced relationship with respect to each other within the enclosure 10 and were electrically connected together as required. Such prior art combinations involve significant amounts of space and weight wherever located such as on a panel or wall. It is the purpose of this invention to reduce the size and weight of the combination of the several devices as presently used.

Figure 2:
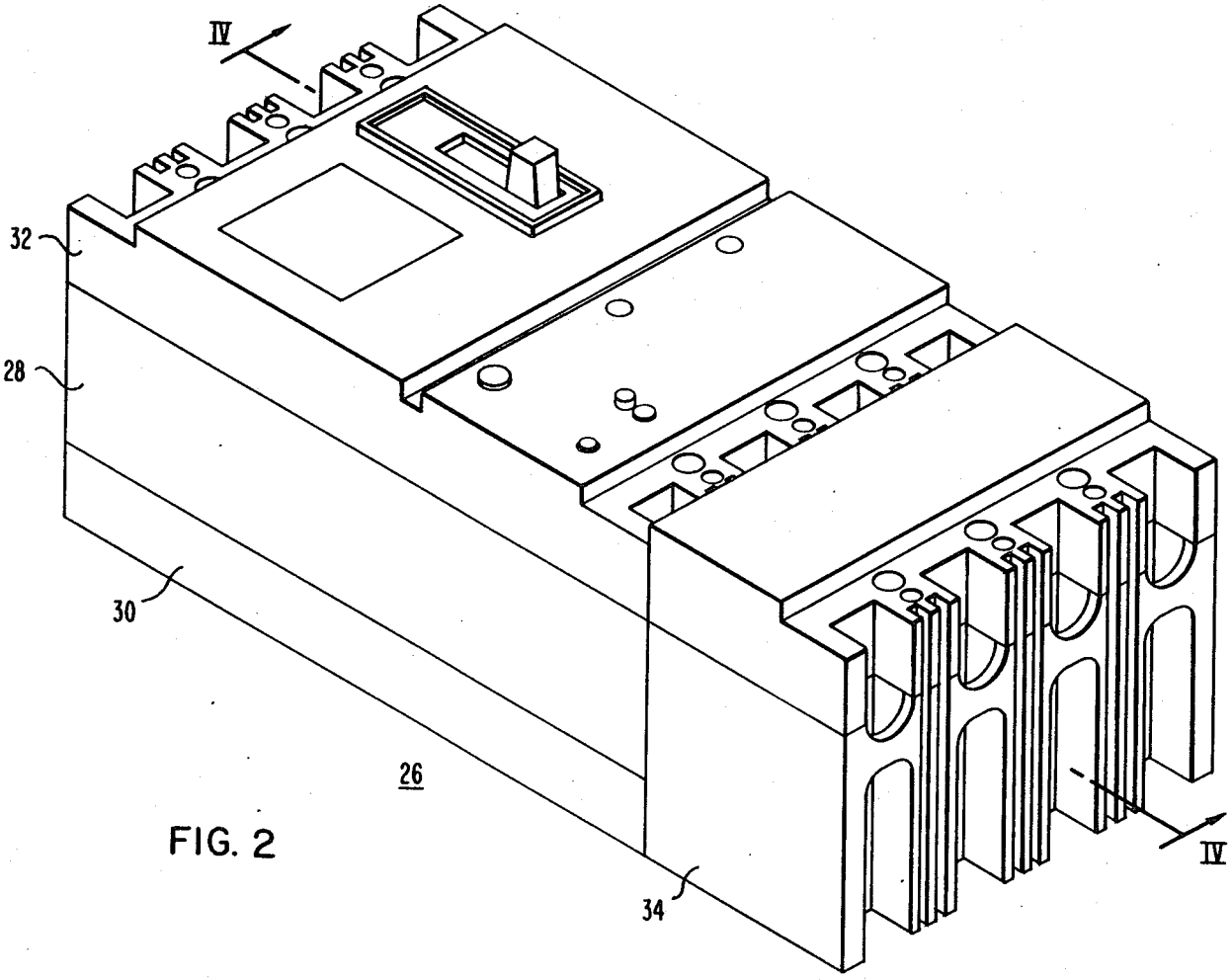
FIG. 2 is a isometric view of the assembled circuit interrupter of this invention.
Figure 3:
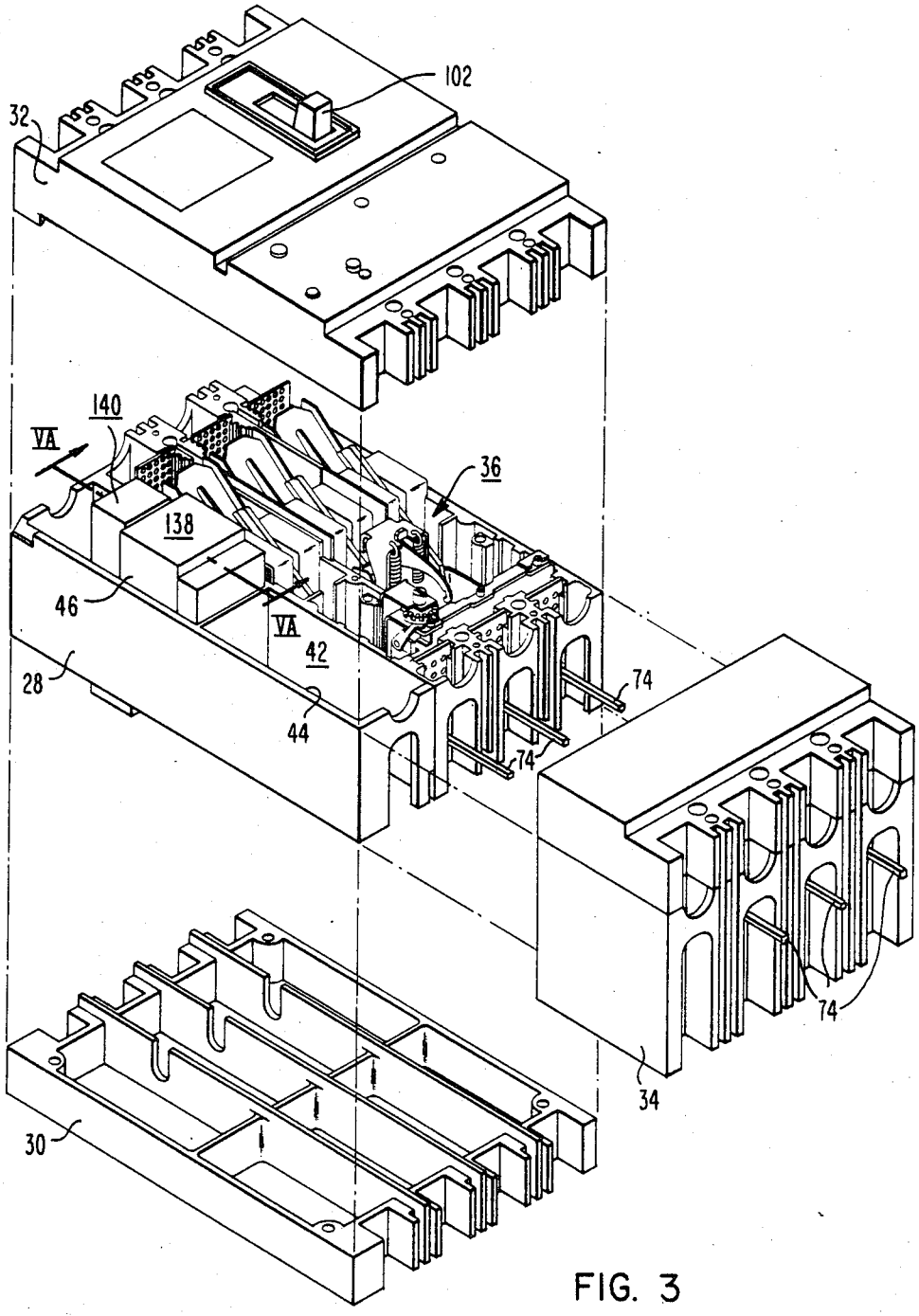
FIG. 3 is an exploded view of the several parts of the circuit interrupter shown in FIG. 2.

In accordance with this invention by way of example as shown in FIG. 2 the functions of most of the several parts shown in FIG. 1 are combined in the manner shown in FIG. 2 and are contained within a housing 28 having a base 30 and a cover 32. A modular overload relay 34 is mounted at one end of the housing 28. In FIG. 3 an exploded view of the housing, base, cover, and overload relay shows how the several modular units are separated as discrete members for assembly as required, and how they may be assembled to provide an integral circuit interruptor.

Figure 4:
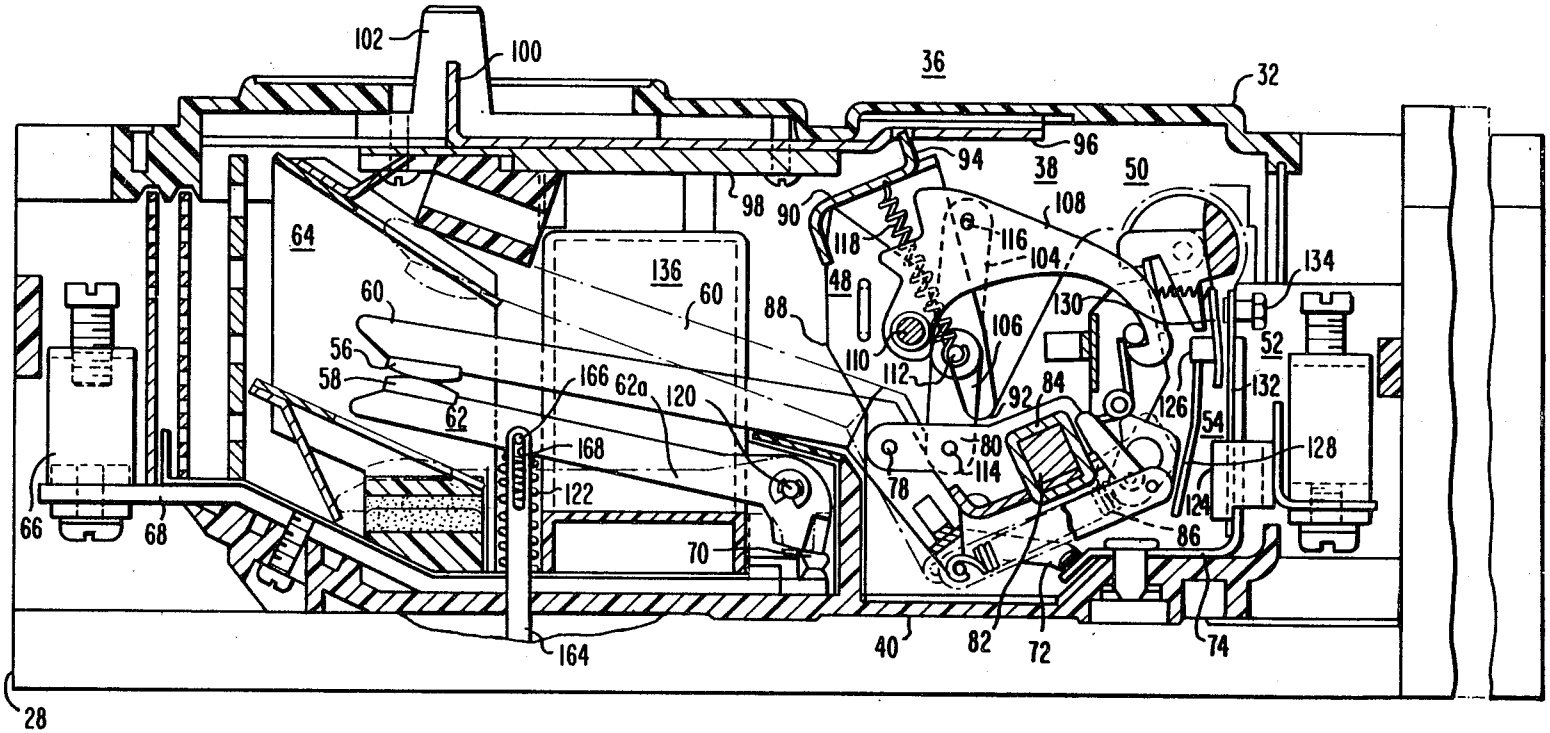
FIG. 4 is a vertical sectional view taken on the line 4—4 of FIG. 2.

The basic unit of the interrupter may be either a single phase or a polyphase structure, preferably it is a three pole circuit breaker 36 comprising the insulating housing 28 and a high speed circuit breaker mechanism 38 (FIG. 4). The housing 28 comprises an insulating bottom wall 40 having a generally planar and insulating barriers 42 (FIG. 3) separating the housing into four adjacent side-by-side pole unit compartments. The circuit breaker 36 is a three pole unit, and for the purpose of this embodiment of the invention a fourth compartment 44 is provided for containment of electromagnetic actuator means 46 (FIG. 3).

The circuit breaker mechanism 38 (FIG. 4) includes a single operating mechanism 48 and a single latch mechanism 50 mounted on the center pole unit. The circuit breaker mechanism 38 also comprises a separate thermal trip device 52 and a high speed electromagnetic trip device 54. These devices are more completely described in U.S. Pat. No. 4,220,935, entitled "Current Limiting Circuit Breaker and High Speed Magnetic Trip Device" of W. E. Beatty and J. A. Wafer, as well as U.S. Pat. No. 4,255,732, entitled "Current Limiting Circuit Breaker", of which the inventors are J. A. Wafer and W. V. Bratkowski. A pair of separable contacts 56, 58 attach to upper and lower pivoting contact arms 60, 62, respectively, are provided in each pole unit of the breaker. An arc extinguishing unit 64 is provided in each pole unit. The circuit through the circuit breaker extends from a terminal 66 through a conductor 68, shunt 70, the lower contact arm 62, the contacts 56, 58, the upper contact arm 60, a shunt 72, and a conductor 74 to a load terminal 76.

The upper contact arm 60 is pivotally connected at a pin 78 to a rotating carriage 80, which is fixedly secured to an insulating tie bar 82 by a staple 84. A tension spring 86 connected between the contact arm 60 and the conductor 74 serves to maintain the upper contact arm 60 in the position shown in FIG. 4, with respect to the carriage 80. The upper contact arm and carriage 80 thus rotate as a unit with the tie bar during normal current conditions through the circuit breaker 36.

The operating mechanism 48 is positioned in the center pole unit of the three pole circuit breaker and is supported on a pair of spaced metallic rigid supporting plates 88 that are fixedly secured to the base 40 in the center pole unit of the breaker. An inverted U-shaped operating lever 90 is pivotally supported on the spaced plates 88 with the ends of the lever positioned in U-shaped notches 92 of the plates.

The operating lever 90 includes a flange 94 extending through a hole in a slide plate 96. The slide plate 96 is slidably attached to the cover 32 by a support plate 98, and includes a flange 100 seated in a molded handle 102.

The upper contact arm 60 of the center pole unit is operatively connected by means of a toggle comprising an upper toggle link 104 and a lower toggle link 106 to a releasable cradle or lever 108 that is pivotally supported on the plates 88 by a pin 110. The toggle links 104, 106 are pivotally connected by a knee pivot pin 112. The toggle link 106 is pivotally connected to the carriage 80 of the center pole unit by a pin 114 and the toggle link 104 is pivotally connected to the releasable lever 108 by a pin 116.

Overcenter operating springs 118 are connected under tension between the knee pivot pin 112 and the bite portion of the lever 90. The lower contact arm 62 is pivotally mounted by pin 120 to the bottom wall 40.

The contacts 56, 58 are manually opened by movement of the handle 102 to the right (FIG. 4) from the ON position to the OFF position. This movement causes the slide plate 96 to rotate operating lever 90, causing the line of action of the overcenter springs 118 to the right enabling collapse to the right of the toggle links 104, 106, which in turn rotates the tie bar 82 in the clockwise direction to simultaneously move the upper contact arm 60 of the three pole units to the open position, opening the contacts of the three pole units. The contact arm 60 is then in the position shown in broken line in FIG. 4.

The contacts are manually closed by reverse movement of the handle 102 from the OFF to the ON position, which movement moves the line of action of the overcenter springs 118 to the left to move the toggle linkage 104, 106 to the position shown in FIG. 4. This movement rotates the tie bar 82 in the counterclockwise direction to move the upper contact arms 60 of the three pole units to the closed position. A compression spring 122 urges the lower contact arm 62 upwardly about the pivot pin 120 for retaining the contact 56, 58 in good electrical contact.

The releasable lever 108 is latched in the position shown in FIG. 4 by the latch mechanism 50, the construction and operation of which are more completely described in U.S. Pat. No. 4,255,732.

The separate high speed electromagnetic trip device 54 is provided for each pole and it comprises a U-shaped pole piece 124, the legs of which extend around the conductor 74. An armature 126 is pivotally supported in the housing and includes a laminated magnetic clapper 128 and an actuating member 130. Each thermal trip device 52 in each pole unit includes a bimetal element 132 having an adjusting screw threaded therein.

When the circuit breaker is in the latched position (FIG. 4), the springs 118 operate through the toggle linkage and the pivot 116 to bias the releasable lever 108 in the counterclockwise direction about the pivot 110. Counterclockwise movement of the releasable lever 108 is restrained by the latch mechanism 50.

Upon occurrence of an overload current of a predetermined value through any of the pole units, the clapper 128 is attracted toward the associated pole piece 124, whereupon the armature 126 pivots in the counterclockwise direction closing the air gap between the pole piece and the clapper and pivoting the armature actuating member 130 in a counterclockwise direction to release the latch mechanism 50. The force of the operating springs 118 upon the knee pin 112 is transmitted through the upper toggle link 104 to cause the releasable lever 108 to rotate in a counterclockwise direction about the pivot 110. Continued rotation of the releasable lever moves the upper toggle pin 116 to the left of the line of action of the operating springs, causing the collapse of the toggle linkage to rotate the carriage 80 in the clockwise direction and move all of the upper contact arms 60 to simultaneously open the contacts of the three pole units.

During this movement the handle 102 is moved to a TRIP position between the OFF and ON positions to provide a visual indication that the circuit breaker has been tripped, the circuit breaker mechanism must then be reset and latched before the circuit breaker can be manually operated after an automatic tripping operation.

With the circuit breaker in the closed and latched position (FIG. 4), the lower current overload condition generates heat and causes the upper end of the bimetal element 132 to flex to the left (FIG. 4). The adjusting screw impinges on the armature 126. This causes clockwise rotation of the trip bar 82 to initiate the tripping action and achieve automatic separation of the contacts of all three pole units with regard to a magnetic trip.

The circuit breaker includes a slotted magnetic drive device 136, the construction and operation of which is set forth in U.S. Pat. No. 4,220,934.

Under the short circuit conditions, extremely high levels of overload current flow through the circuit breaker 36. The current flow through the conductor 68 and the lower contact arm 62 generates a large amount of magnetic flux in the slotted magnetic drive device or slot motor 136 which produces a high electrodynamic force upon the lower contact arm 62, tending to drive the arm from the closed position (FIG. 4) to the broken line position 62. In addition, the current flow through the contact arms 60, 62, in opposite directions, generates a high electrodynamic repulsion force between the arms which builds up extremely rapidly upon occurrence of a short circuited condition, causing the upper contact arm 60 to pivot clockwise about its pin 78, and acting against the force of the spring 86, from the closed position to the current limiting position shown broken line in FIG. 4.

The electromagnetic actuating means 46 (FIG. 5) comprises an electromagnet 138, an armature 140, a cross bar 142 (FIG. 5), and a linkage structure 144. The armature 140 is mounted on the crossbar 142 which is rotatably mounted for rotation of the armature through an angle of approximately 20 degrees into and out of contact with a core 139 of the electromagnet 138. The core 139 includes a coil 141. A spring 146 is disposed between the armature 140 and the core 139 which spring rotates the armature away from the core when the latter is deenergized. Thus the electromagnetic actuator means 46 includes a fail safe operation. The armature and the core are comprised of a plurality of laminated steel plates in a conventional manner and are enclosed within an insulating material such as epoxy. The assembly of the armature 140 and its inclosure is referred to as the armature 140. The electromagnet 138 is an assembly of the core 139 and its inclosure.

Figure 5:
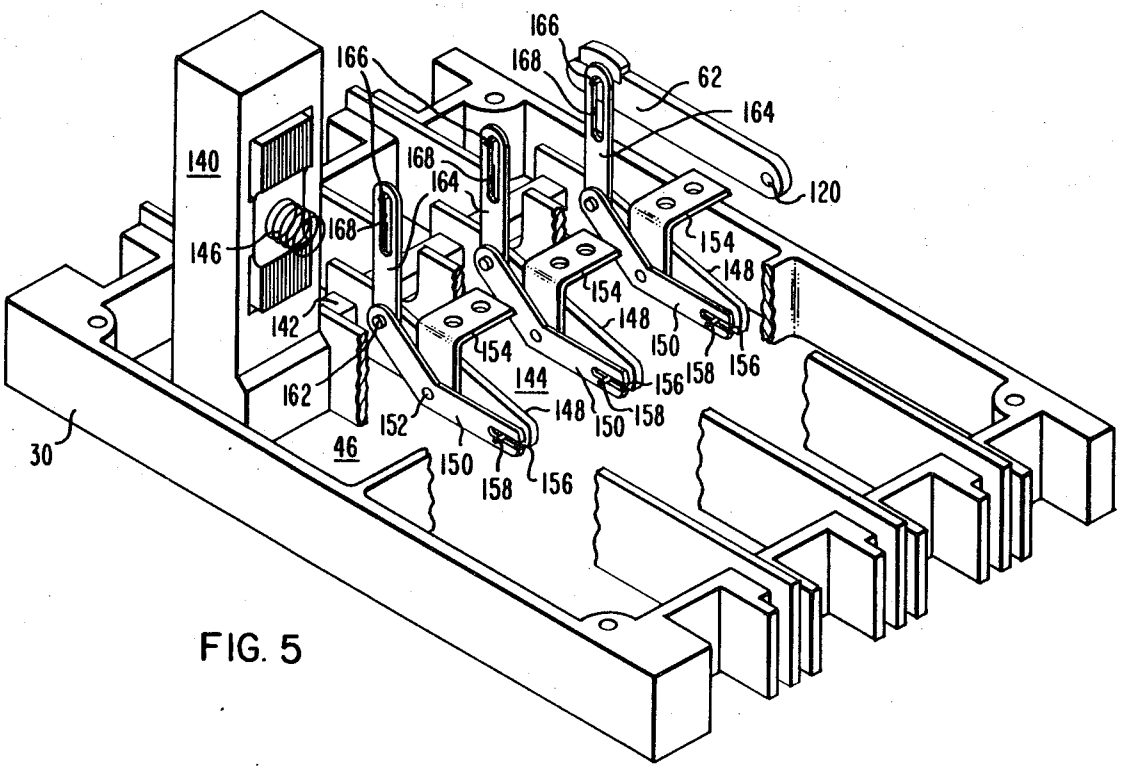
FIG. 5 is an isometric view of the base and electromagnetic actuator.
Figure 5A:
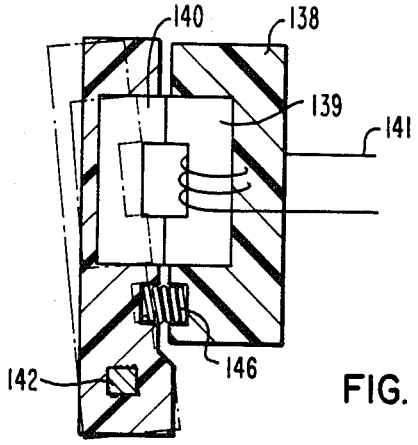
FIG. 5A is a fragmentary sectional view taken on the line 5A—5A of FIG. 5.

The linage structure 144 include similar spaced arms 148, one for each phase, which are fixedly mounted on the cross bar 142 for rotation with the bar in response to rotation of the armature 140. Each arm 148 includes a lever 150 which is pivotally mounted on a pivot pin 152 secured to a fixed frame member 154. The right end (Figure 5) of each lever 150 includes a slot 156 for receiving a pin 158 extending from each corresponding arm 148. The other end of each arm 150 is pivotally secured by a pin 162 to a link, 164 which extends upwardly through an opening in the bottom wall 40 (FIG. 4) to the contact arm 62 to which it is attached by a pin 166 (FIGS. 4 and 5). Accordingly, when the core 139 is energized, the links 164 are disposed in the upper positions as shown.

Each link 164 includes a longitudinal slot 168 and the spring 122 (FIG. 4) retains the arm 62 in the upper position for maintaining good electrical contact between the contacts 56, 58. In that position, the pin 166 is disposed at the upper end of the slot 168, which position is normally maintained by continued energization of the core 139 of the electromagnet. When the core 139 is deenergized, the coil spring 146 forces the armature 140 to rotate counterclockwise through an arc of about 15 to 20 degrees, thereby lowering the links 164 to pull down the lower contact arms 62 and open the contacts 56, 58. Thus the electromagnetic actuator means 46 functions as a contactor by lowering the contact arms 62 to separate the contacts.

Moreover, when the core 139 is energized so that the contact 56, 58 are closed, the provision of the slots 168 in the links 164 enable the substantially parallel contact arms 60, 62 to function as current limiters. Thus, when a high value short circuit occurs, the arms blow apart with the several pins 166 (FIGS. 4, 5) free to move downwardly through the slots without interference from the linkage structure 144.

Figure 6:
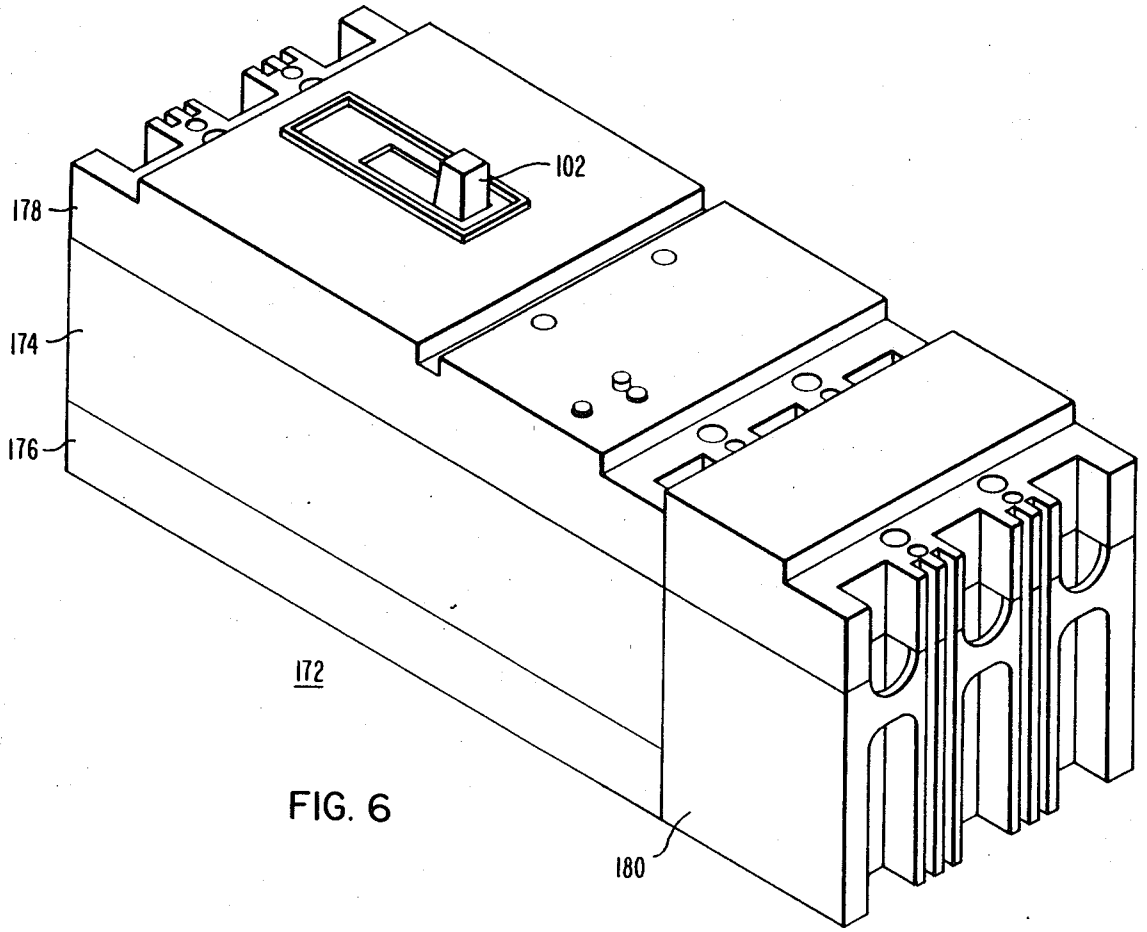
FIG. 6 is an isometric view of the circuit interrupter of the second embodiment.
Figure 7:
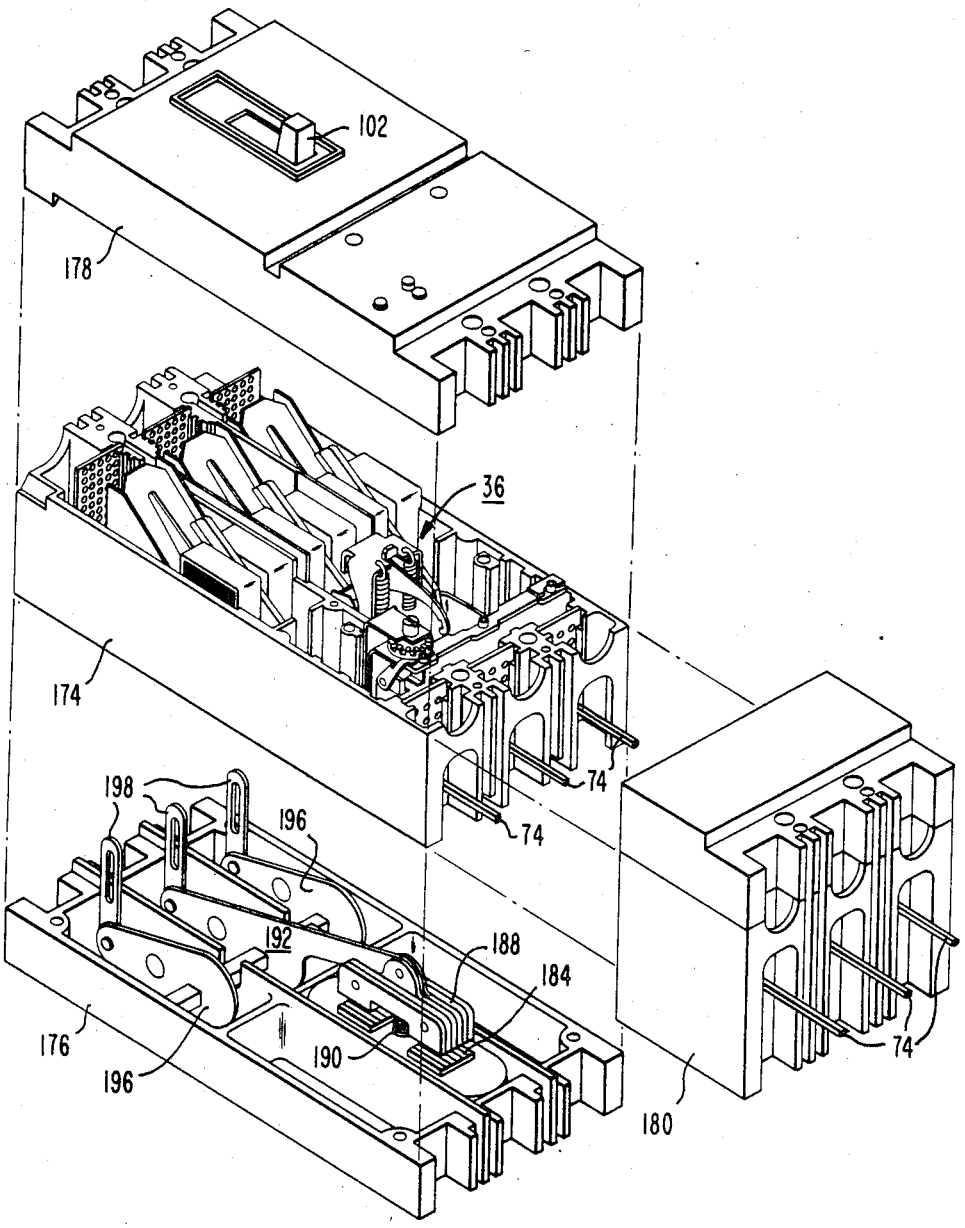
FIG. 7 is an exploded view of the second embodiment of this invention.
Figure 8:
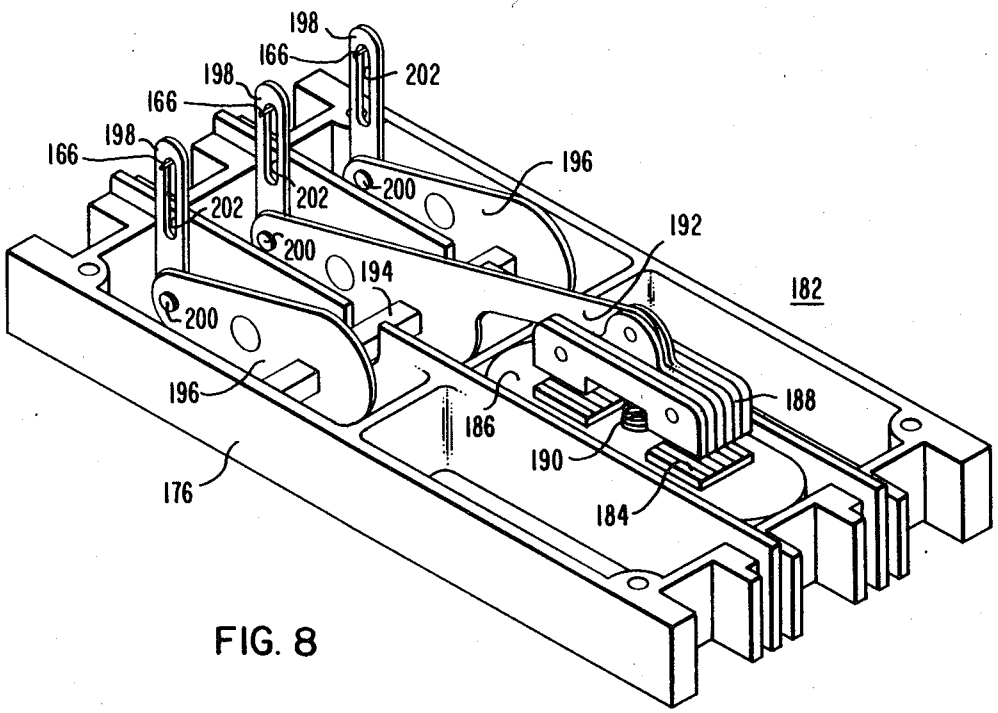
FIG. 8 is an isometric view of the base assembly of the second embodiment of this invention.

Another embodiment of the invention is shown in FIG. 6 in which a circuit interrupter 172 comprises a circuit breaker housing 174, a base 176, a cover 178, and an enclosure 180 for overload current monitoring means. In FIG. 7 the several housing portions 174–180 are shown in the exploded positions. One distinction between the embodiments of this invention is that in the embodiment of FIGS. 2–5 the electromagnetic actuator is disposed in a housing portion or cell on one side of the circuit breaker. The embodiment of FIGS. 6–8 comprises an electromagnetic actuator means 182 within the base 176, or below the circuit breaker housing 174.

The electromagnetic actuating means 182 (FIG. 8) comprises an electromagnetic core 184 which is encapsulated within a body 186 of insulating material such as epoxy. An armature 188 is disposed above the core 184 and is normally retained in space relation therewith by a coil spring 190. The electromagnetic actuator means also includes linkage comprising a lever 192, a cross bar 194 and similar spaced arms 196. The lever and arms are fixedly mounted on the cross bar 194 which rotates in response to movement of the armature 188. The linkage also includes links 198 which are pivotally connected by pins 200 to the lever 192 and corresponding arms 196.

The links 198 are similar in construction and operation to the links 164 in that the links 198 likewise include elongated slots 202 for engagement with pins 166 on the lower contact arms 62 (FIG. 4). Accordingly, when the electromagnetic actuator 182 is energized, the links 198 are elevated to enable good electrical contact between the contacts 56, 58. In that condition the slots 202 (FIG. 8) like the slots 168 (FIG. 4), enable the contact arms 60, 62 to blow apart in a manner similar to that of the first embodiment.

Likewise, when the electromagnetic actuator means 182 is deenergized, the spring 190 lifts the armature 188 from the core 184 and thereby lowers the contact arms 62.

Figure 9:
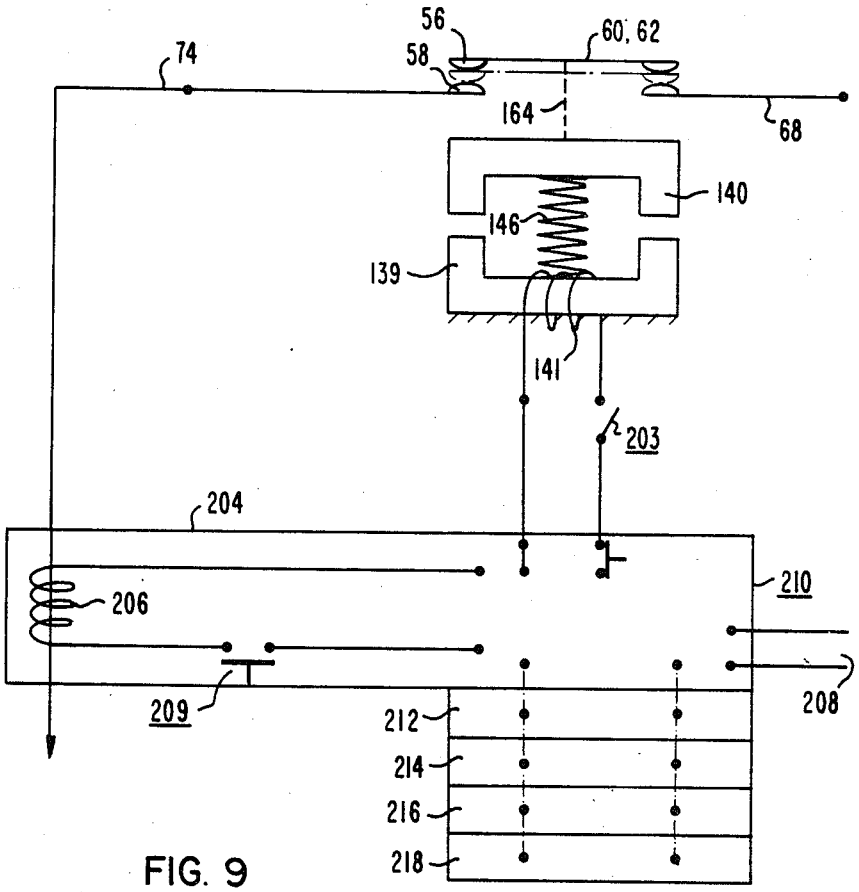
FIG. 9 is a schematic view of a circuit diagram of the modular sensor.

Normally, when the handle 102 is moved to the left (FIG. 4) to close the contacts 56, 58, a switch 203 (FIG. 9) is closed which energize the electromagnetic coil 141. The lower contact arms 62 are biased upwardly by the spring 122. But when the voltage on the coil 141 is lost due to some failure, the electromagnet opens due to the spring 146 which in turn pulls down the lower contact arms 62 through the limbs 164 and opens the load contacts 56, 58.

The electromagnetic actuator means 182 may also be energized or deenergized in a number of ways including a remotely controlled relay 209 either manually or computer controlled (FIG. 9), such as by a public utility function, and overriding any other circuit to the means 182. In addition, the electromagnetic actuator means 182 may be controlled by modular overload control means contained within the enclosure 180.

For that purpose the means 182 may be comprised of either a bimetal device, a thermal magnetic device, or combinations thereof. The overload control means may also be comprised of other types of current sensing such as of the solid state type. Whatever current sensor device is provided for the purpose of this invention, it is modular in structure and detachably mounted on the circuit breaker housing 174 for removal and replacement by similar modules of different current ratings as required. For example, a current sensor for lower, intermediate, or higher predetermined overload currents may be provided in conjunction with the electromagnetic actuator means 182.

For the purpose of this invention, a modular overcurrent sensor 204 within the enclosure 180 is provided for energizing or deenergizing only the electromagnetic actuator means 46. The trip device 54 operates independently of the sensor 204, though both monitor the same current flowing through the circuit breaker 36.

The sensor 204 comprises a current transformer 206 for each phase and an inverse time delay logic circuit 210 having a supply time 208. The sensor 204 also comprises one or more optional control plug-in modules, in conjunction with the circuit 210, as required, such as a phase unbalanced module 212, an overload module 214, a long time acceleration module 216, and a heater module 218. The modules are detachably mounted and used either separately or in combination as required. Thus, an overload current signal from the coil 206 is received by the inverse time delay logic circuit 210 where it is analyzed and compared with a predetermined threshold value that is set on the overload module 214. If the signal exceeds the threshold value the logic circuit 210 opens the circuit to the electromagnetic coil 141. To deenergize the electromagnet and open the contacts 56, 58.

Thus, the circuit interrupter 36 comprises the high speed thermal magnetic trip device 54 and the modular overcurrent sensor 204. The former is set at a fixed rate or bimetal setting. The latter is adapted for variable ratings within the bimetal setting as required.

In accordance with this invention the modular overcurrent sensor 204 monitors the current through the circuit breaker for controlling the electromagnetic actuator means 46 or 182 in addition to the control of said means by a remotely controlled device. Normally the remotely controlled device overrides the modular overcurrent sensor 204.

In conclusion, the circuit interrupter of this invention provides a new and miniaturized integral motor controller that performs all of the functions of the discrete components including a circuit breaker, a contactor, a current limiter, through one pair of contacts. The circuit interrupter results in the function of motor controlling and energy management.

What is claimed is:

1. A circuit breaker comprising:

an electrically insulating housing;

a circuit breaker within the housing and including first and second separable contacts operable between open and closed contact positions;

the circuit breaker including a releasable lever movable when released to a tripped position to effect automatic opening of the contacts in response to a first predetermined current condition;

the circuit breaker also including a current detector for monitoring said first predetermined current condition and for automatically tripping the releasable lever in response to said first predetermined overcurrent condition;

the first contact being mounted on a first movable contact carrying armand coupled to the releasable lever;

the second contact being mounted on a second contact carrying arm being movable between open and closed positions;

electromagnetic actuating means for moving the second contact arm between said open and closed positions;

modular sensor means for monitoring current flow and for automatically actuating only the electromagnetic means in response to a second predetermined current condition and the modular sensor means being removably mounted and replaceable by modular sensor means of different current ratings.

2. The circuit interrupter of claim 1 in which the electromagnetic actuating means comprises an armature and linkage assembly connected to the second contact carrying arm.

3. The circuit interrupter of claim 1 in which the first and second contacts are the only contacts in the circuit interrupter.

4. The circuit interrupter of claim 1 in which the current detector is comprised of a modular structure that is removably and replaceably mounted on the housing.

5. The circuit interrupter of claim 4 in which the elecromagnet actuating means is controlled by remotely controlled signals.

* * * * *